US005411365A

United States Patent [19]

Mazzola et al.

[11] Patent Number: 5,411,365

[45] Date of Patent: May 2, 1995

[54] HIGH PRESSURE/INTERMEDIATE PRESSURE SECTION DIVIDER FOR AN OPPOSED FLOW STEAM TURBINE

[75] Inventors: Mario A. Mazzola, Ballston Lake; Thomas J. Farinean, Scholhane; George Schlottner, Delanson; Earl H. Brinkman, Schenectady, all of N.Y.

[73] Assignee: General Electric Company, Schenectady, N.Y.

[21] Appl. No.: 161,117

[22] Filed: Dec. 3, 1993

[51] Int. Cl.[6] ..... F01D 3/02

[52] U.S. Cl. ..... 415/93; 415/108

[58] Field of Search ..... 415/93, 108, 115

[56] References Cited

U.S. PATENT DOCUMENTS

| | | | |
|---|---|---|---|
| 718,661 | 1/1903 | Schultz . | |
| 895,644 | 8/1908 | Jude . | |
| 2,211,857 | 8/1940 | Kroon | 415/115 |
| 2,633,291 | 3/1953 | Trumpler . | |
| 3,107,084 | 10/1963 | Conrad, Sr. et al. . | |
| 3,189,320 | 6/1965 | Beldecos et al. | 415/115 |
| 3,206,166 | 9/1965 | Beldecos et al. | 415/93 |
| 3,659,956 | 5/1972 | Brinkman . | |
| 4,482,293 | 11/1984 | Perry . | |
| 5,037,267 | 8/1991 | Halberg | 415/108 |
| 5,037,269 | 8/1991 | Halberg . | |

*Primary Examiner*—John T. Kwon

*Attorney, Agent, or Firm*—Nixon & Vanderhye

[57] ABSTRACT

In an opposed flow high pressure section, intermediate pressure section steam turbine (10), an annular section divider (142) is located axially between the high pressure section (HP) and the intermediate pressure section (IP), and substantially eliminates conventional inner shell sections. Thus, the turbine has only a single outer shell to which the blades of the turbine stages outside the divider 142 are operatively sealed. The section divider (142) incorporates partial arc steam admission chambers (150); supports a nozzle plate assembly (146); and includes integral steam packing (156) to seal the rotor interface.

9 Claims, 4 Drawing Sheets

HIGH PRESSURE/INTERMEDIATE PRESSURE SECTION DIVIDER FOR AN OPPOSED FLOW STEAM TURBINE

TECHNICAL FIELD

This invention relates to steam turbines and, more specifically, to a novel section divider between the high and intermediate pressure sections of an opposed flow steam turbine.

BACKGROUND

The design of reliable, efficient steam turbines requires the application of many diverse areas of technology. There are many competing design and material requirements that must be thoroughly evaluated, so that optimum trade-offs can be achieved. The overriding objective in all steam turbine design activities is to produce steam turbine designs which minimize the life cycle cost of ownership.

The total cost of ownership of a steam turbine generator can be considered to be made up of two components. The first of these is the initial cost or purchase price for acquiring and installing the equipment. The second component is the subsequent operating costs for fuel, operation and maintenance, and unplanned outages.

Of primary significance is that factors such as reliability, efficiency, availability, maintainability and operability, which are functions of the design and construction of the equipment, will affect the operating and maintenance costs of the user. At the same time, marketing pressures require that to be competitive, the manufacturing cycle, installation cycle, and life cycle costs of turbines be reduced without impact on performance and quality.

Opposed flow high pressure/intermediate pressure steam turbines are typically constructed so that the high and intermediate pressure sections are contained within a single outer casing. However, separate inner shells are employed for the high and intermediate sections (as will be explained in more detail below, in connection with FIG. 1). This arrangement has resulted in significant manufacturing and shipping cycles and related costs.

With reference now to FIG. 1, an opposed flow high pressure/intermediate pressure steam turbine 10 in accordance with conventional practice is illustrated. This turbine includes a high pressure section designated HP, and an intermediate pressure section designated IP. From left to right, this conventional turbine includes a thrust beating 12 and a journal bearing 14 along with steam packing 16. The turbine also includes an outer high pressure shell 18, nozzle diaphragms 20, a high pressure exhaust 22, bucket blades 24, and an inner high pressure shell 26. High pressure steam inlets are shown at 28, with a first stage nozzle box shown at 30. Additional steam packing is provided at 32 to separate the high pressure section from the intermediate pressure section.

The intermediate pressure section IP has a separate inner shell 34 adjacent a cross-over pipe 36, and also includes nozzle diaphragms 38, and bucket blades 40. Additional steam packing is provided at 42, and a suitable journal bearing is shown at 44. A reheat or intermediate pressure inlet is shown at 46.

A single high pressure rotor 48 is also shown, extending between the high pressure and intermediate sections HP and IP of the turbine 10.

In the illustrated design, the high pressure (HP) and intermediate pressure (IP) sections are designed so that the various stages are all contained within the single outer casing or shell 18, in an opposed flow arrangement. In such arrangements, the HP section is combined with a single flow IP section within the same beating span as defined by journals 14 and 44. This results in a significantly more compact turbine and stage arrangement than that of a unit with high pressure and intermediate pressure or reheat sections in separate bearing spans.

High pressure steam enters the center of the section via inlet 28 and flows in one direction, i.e., to the left in FIG. 1, while steam reheated to a similar temperature also enters near the center via intermediate section inlet 46 and flows in the opposite direction. This opposed flow arrangement confines the highest temperature steam to a single central location and results in an even temperature gradient from the center towards the ends, with the coolest steam adjacent to the end packings 16, 42 and bearings 14, 44.

The steam turbine of the type described hereinabove, is also designed for partial arc admission to improve part load efficiency. With partial arc admission, the first stage nozzles are divided into separate nozzle chambers or arcs (typically four for larger units with nozzle boxes and six for smaller units), and each arc is independently supplied with steam by its own control valve.

DISCLOSURE OF THE INVENTION

It is a principal object of this invention to devise a simplified method of separating high and intermediate pressure sections in an opposed flow turbine, while providing partial arc operation, and while permitting single outer shell or casing design. A further objective is to simplify raw material procurement, manufacturing cycle, and installation, and reducing attendant cycles and costs.

In accordance with an exemplary embodiment of the invention, the inner shells for the high and intermediate pressure sections are substantially eliminated in favor of a new section divider separating the high and intermediate pressure sections. This arrangement also results in a smaller, lighter outer shell or casing design.

The section divider in accordance with an exemplary embodiment of this invention, has separate steam chambers to provide desirable partial arc operation, i.e., four (or as many as six) steam chambers are located annularly within the divider and about the turbine rotor, and it will be appreciated that steam from each chamber is separately controlled by its own valving.

The present section divider design also accommodates sufficient staging to permit single shell construction downstream of the divider. Leakage control between the high pressure and intermediate pressure sections of the outer shell is maintained by integral packing at the generator end of the section divider with a provision for a blowdown connection to prevent turbine overspeed upon turbine shutdown. At the same time, the substantial elimination of the inner shells requires that the diaphragm stages are supported by and seal against ledges in the outer shell or casing.

The control stage nobles are contained in an assembly that is bolted to the divider at its inner diameter and locked to the divider with expandable ring segments at its outer diameter. The divider is located axially by a 360° male fit in the outer shell which also separates shell pressure downstream of the divider from reheat bowl pressure. The divider is also keyed transversely to the outer shell at the vertical center line, and is supported on ledges cast into the lower outer shell. The upper outer shell thus locks the divider in place. Access to the rotor for field balancing is provided in the packing area.

In its broader aspects, the present invention relates to an opposed flow high pressure section, intermediate pressure section turbine, wherein the high pressure section and intermediate pressure section are enclosed within a single outer shell in a single tinting span, and specifically to an improvement comprising an annular section divider located axially between the high pressure section and the intermediate pressure section, the section divider confined to an area axially between turbine blades of the high pressure section and turbine blades of the intermediate pressure section, and wherein said turbine blades outside the divider are operatively sealed by the diaphragms supported by the single outer shell.

In another aspect, the invention relates to an opposed flow steam turbine comprising a high pressure section and an intermediate section separated axially by an annular section divider, the section divider provided with a plurality of steam chambers for feeding steam to at least the high pressure section of the turbine, the section divider having steam packing for controlling steam leakage between the high pressure section and the intermediate section along an interface with the rotor.

It will be appreciated that the turbine section divider in accordance with this invention meets the objectives of simplification of raw material procurement, as well as reductions in manufacturing, shipping and installation cycles and related costs.

Additional objects and advantages of the present invention will become apparent from the detailed description which follows.

BEST MODE FOR CARRYING OUT THE INVENTION

In accordance with the present invention, further improvements are effected in an opposed flow high pressure/intermediate pressure turbine, particularly with respect to homing and shell design. More specifically, the present invention results in the substantial elimination of the inner high pressure shell 26, and the intermediate inner shell 34 illustrated in FIG. 1, in favor of a single HP/IP section divider as described below in conjunction with FIGS. 2 through 4.

Figure 2:
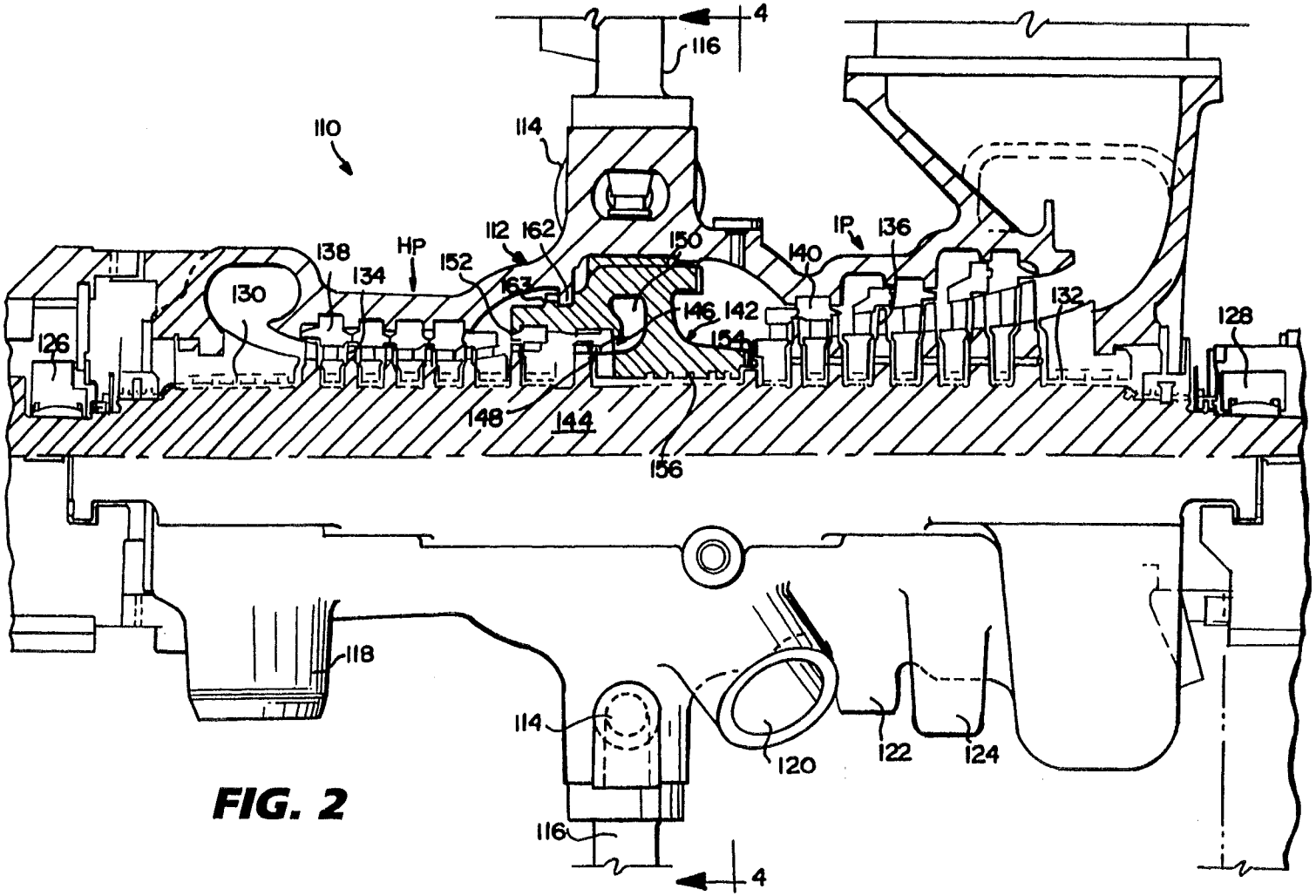
FIG. 2 is a side elevation, partially in section, illustrating high pressure and intermediate (or reheat) pressure sections of an opposed flow, steam turbine incorporating a section divider in accordance with an exemplary embodiment of this invention.
Figure 3:
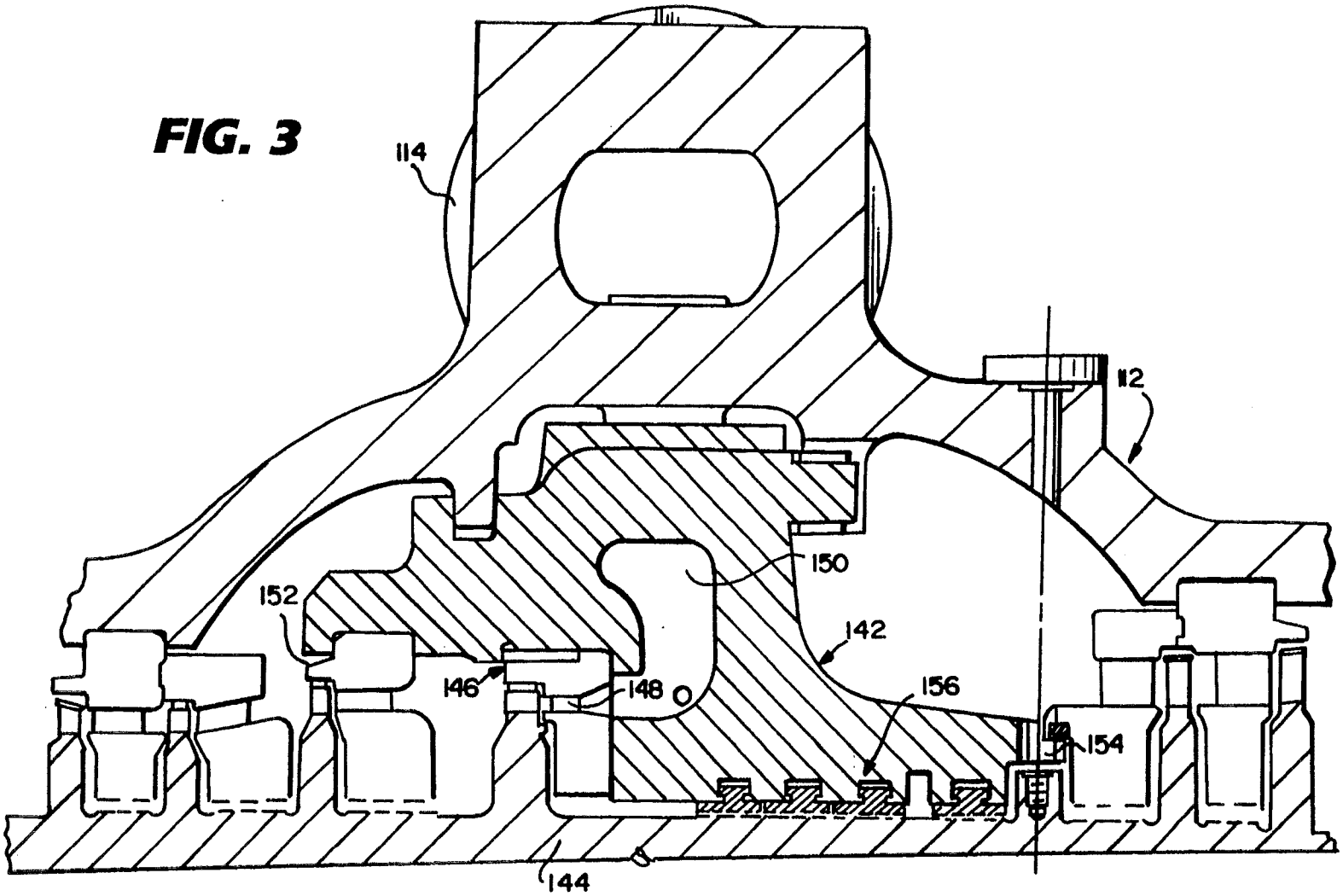
FIG. 3 is an enlarged detail taken from FIG. 2.

More specifically, and with reference to FIGS. 2 and 3, thee is shown an opposed flow high pressure/intermediate pressure steam turbine 110 including a high pressure section HP and an intermediate pressure section IP. A single outer shell or casing 112 (divided axially into upper and lower half sections) spans both the high pressure and intermediate pressure sections. The central section of the single shell 112 includes main steam inlets 114 and associated control valves 116. The shell also includes a high pressure exhaust 118, an intermediate pressure (or reheat) inlets 120, and steam extraction ports 122, 124. Within the outer shell or casing 112, the high pressure and intermediate pressure sections are arranged in a single bearing span as in the prior art construction, the beatings illustrated at 126 and 128. The steam packing units are shown at 130, 132, and, of course, in each of the high pressure and intermediate pressure sections, there are a plurality of bucket blades, e.g., 134, 136, in axially arranged stages, and associated nozzle diaphragms 138, 140 as in conventional designs. With the substantial elimination of the conventional inner shells, the diaphragms in the various stages are operatively supported directly by the outer shell or casing, and the various bucket stages sealed against the diaphragms in an otherwise conventional manner.

Figure 4:
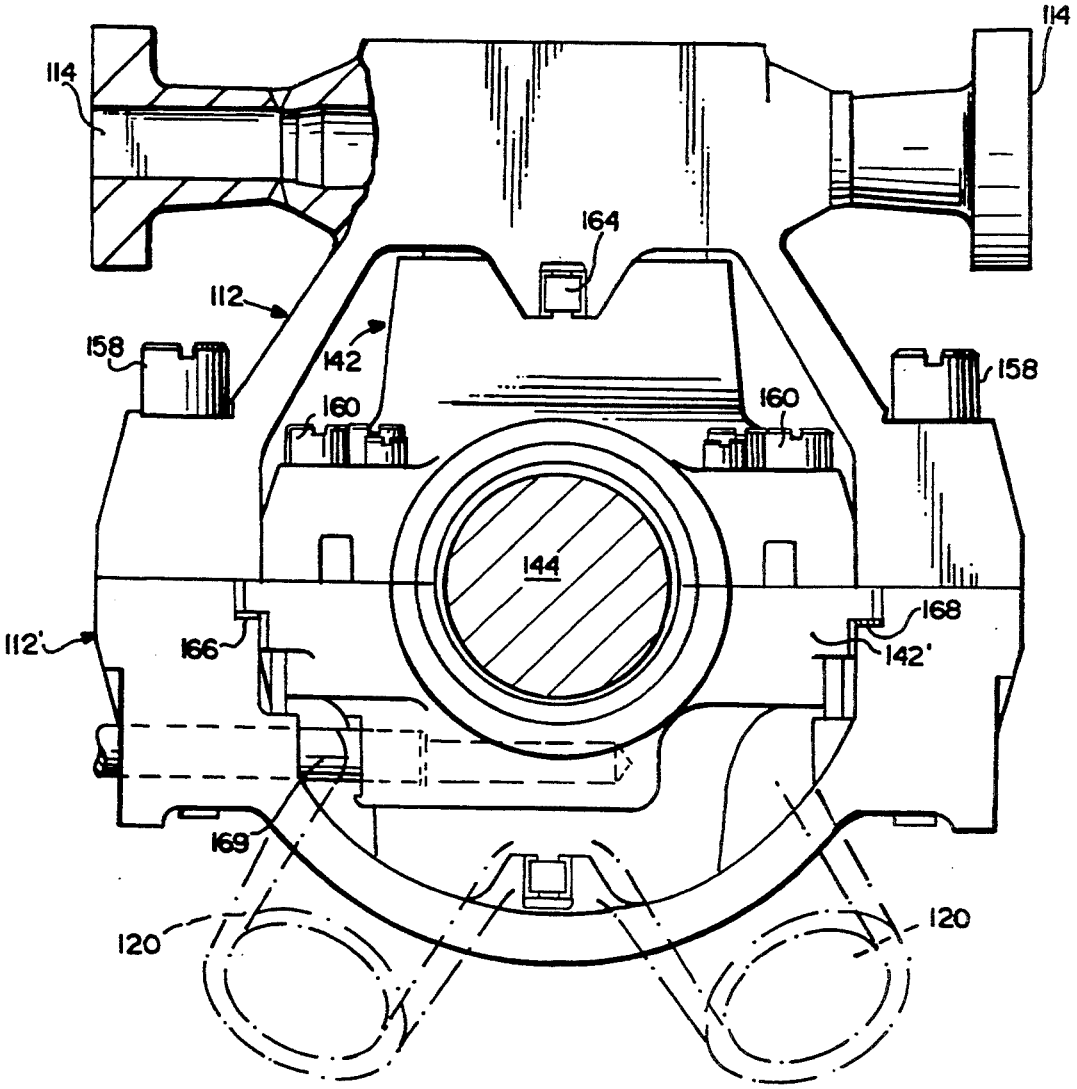
FIG. 4 is a partial section taken along the line 4—4 of FIG. 2.

An annular section divider 142 surrounds the rotor 144 between the high pressure and intermediate pressure sections HP, IP, respectively. Generally, the section divider extends between the fast, second or third rows of blades in the HP section (depending on turbine rating) and the first row of blades in the IP section. Thus, rows of blades outside the divider 142 are operatively sealed by diaphragms supported by the single outer shell. In the illustrated embodiment, the section 142 divider supports a noble plate assembly 146 for first stage nozzles 148 (one shown) which introduce steam in a direction from right to left into the high pressure section HP. The nozzle plate assembly 146 is bolted to the divider 142 at its inner diameter, and locked to the divider with expandable ring segments (not shown) at its outer diameter. The section divider 142 is shown to include a partial are or chamber 150, one of four (or as many as six) such chambers located annularly about the rotor 144, each controlled by a separate valve, not shown. The chamber 150 shown feeds steam to the nozzle 148. The section divider 142 is sealed in the high pressure section HP at 162 and in the intermediate section IP at 154. Leakage control between the high pressure and intermediate pressure sections of the outer shell 112 at the rotor interface is maintained by the integral steam packing 156 at the generator end of the divider 142. The blowdown connection 169 is shown in FIG. 4. The section divider 142 in accordance with this invention thus combines the functions of a nozzle box, inner shell and packing head, thus achieving all desired objectives.

Turning to FIG. 4, it will be appreciated that the single outer shell 112 is formed in two half sections, designated 112 and 112'. Similarly, the section divider 142 is formed in two half sections designated 142, 142'. The sections of both the outer shell and the section divider are bolted together in the manner shown in FIG. 4, utilizing bolts 158, 160, respectively. In addition, the section divider 142 is located axially by a 360° male fit at 162 in the outer shell (see FIG. 2), which also separates shell pressure upstream of the divider from reheat bowl pressure. The male fit 162 is received within a mating groove 163 formed in the divider 142. The divider 142 is also keyed transversely to the outer shell at the vertical centerline of the turbine, as shown at 164 in FIG. 4. The divider 142 is also supported on ledges 166, 168 (FIG. 4) cast into the lower shell 112'.

Thus, the upper outer shell 112 locks the divider 142 in place.

Figure 1:
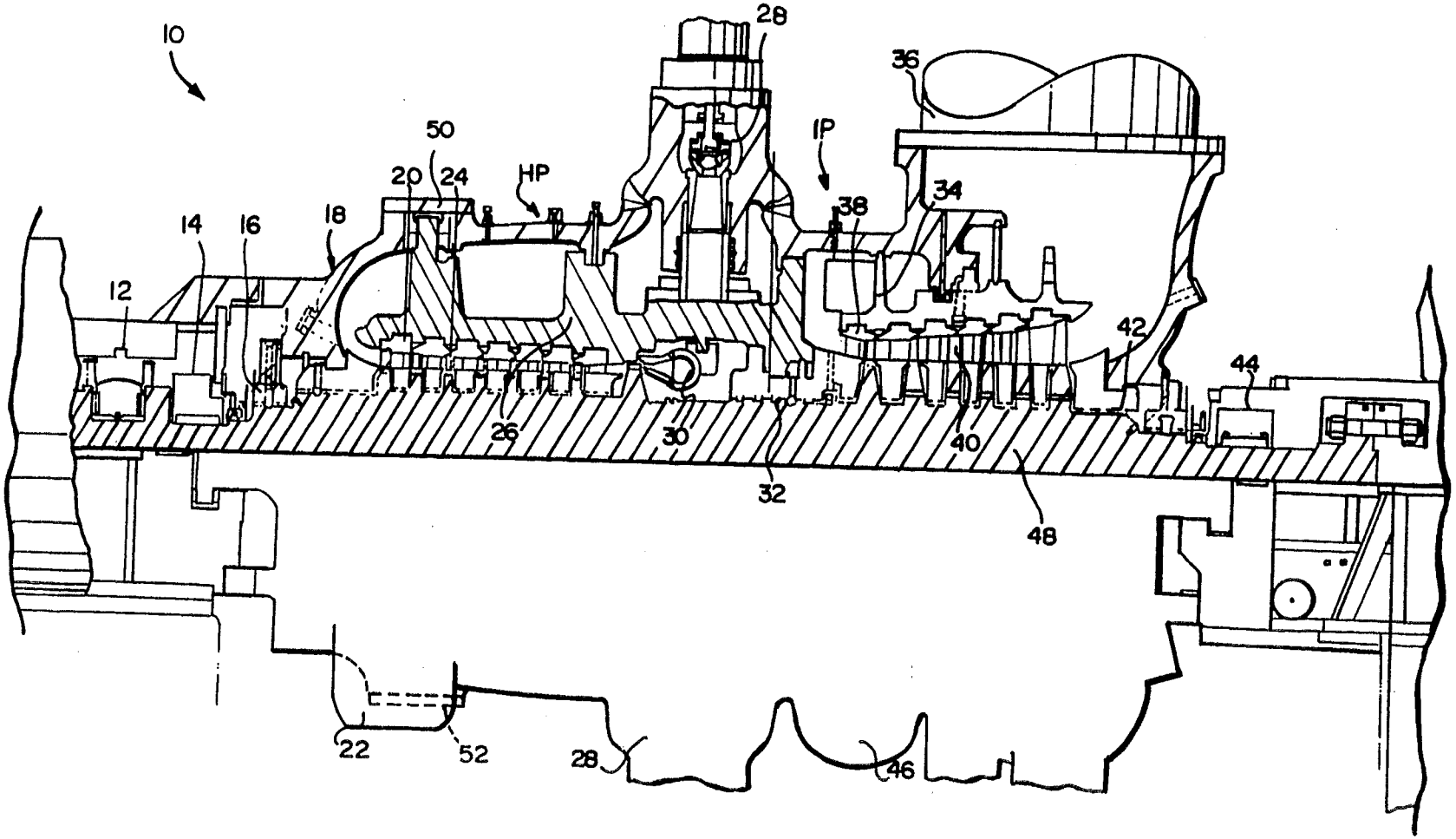
FIG. 1 (PRIOR ART)
FIG. 1 is a side elevation, partly in section, showing the high pressure and intermediate or reheat sections of a conventional, opposed flow steam turbine.

The section divider 142 is significantly lighter than an inner shell such as shown 26 in FIG. 1 and, as a result of the elimination of the inner shell, all associated gib post manufacturing costs and cycles and the risk of leakage at the bolted gib cover (see elements 50, 52 in FIG. 1) have also been eliminated. The installation time/outage time required to install the section divider 142 is also significantly shorter because of the elimination of heat stretching the inner shell bolts and fitting of the inner gib post shims.

While the invention has been described with respect to what is presently regarded as the most practical embodiments thereof, it will be understood by those of ordinary skill in the art that various alterations and modifications may be made which nevertheless remain within the scope of the invention as defined by the claims which follow.

What is claimed is:

1. An opposed flow steam turbine comprising a high pressure section and intermediate section enclosed within a single outer shell and separated axially by an annular section divider, said section divider provided with a plurality of steam chambers for feeding steam to at least the high pressure section of the turbine, said section divider having steam packing for controlling steam leakage between the high pressure section and the intermediate section along an interface with said rotor, and wherein turbine blades in said high pressure section and said intermediate pressure section on either side of said divider are operatively sealed directly with portions of said single outer shell.

2. The turbine of claim 1 wherein said section divider is located axially relative to said single outer shell by an annular male fit formed in said single outer shell and seated within a mating groove formed in said section divider.

3. The turbine of claim 1 wherein said section divider is keyed transversely to said single outer shell at a vertical centerline of the turbine.

4. The turbine of claim 2 wherein said section divider is keyed transversely to said single outer shell at a vertical centerline of the turbine.

5. The turbine of claim 1 wherein said section divider is supported on shoulders formed in a lower portion of said single outer shell.

6. The turbine of claim 1 wherein said high pressure section and said intermediate pressure section are enclosed within a single shell in a single bearing span.

7. The turbine of claim 1 wherein said section divider includes a nozzle plate assembly with a plurality of nozzles arranged to introduce steam into said high pressure section.

8. The turbine of claim 7 wherein said section divider is formed with a plurality of nozzle chambers, each supplying steam to one of said plurality of nozzles.

9. The turbine 9 of claim 1 wherein said section divider is formed with upper and lower half portions, securable together along a horizontal interface substantially aligned with the axis of the rotor.

* * * * *